United States Patent [19]

Jacobs

[11] 4,232,759

[45] Nov. 11, 1980

[54] MOBILE LADDER-SCAFFOLDING SYSTEM

[76] Inventor: Ronald S. Jacobs, 1953 Hill Ave., Baltimore, Md. 21234

[21] Appl. No.: 63,078

[22] Filed: Aug. 2, 1979

[51] Int. Cl.[3] ..... E06C 1/397; E06C 5/00; E06C 9/12; E04G 3/14

[52] U.S. Cl. ..... 182/39; 182/45; 182/117; 182/214

[58] Field of Search ..... 182/39, 38, 36, 45, 182/117, 214, 118, 116

[56] References Cited

U.S. PATENT DOCUMENTS

| | | | |
|---|---|---|---|
| 891,379 | 6/1908 | Scott | 182/38 |
| 1,412,060 | 4/1922 | Mattson | 182/45 |
| 1,692,664 | 11/1928 | Kirsch | 182/117 |
| 2,043,312 | 6/1936 | Warner | 182/117 |
| 2,359,868 | 10/1944 | Mick | 182/116 |
| 2,663,484 | 12/1953 | McPherson | 182/118 |
| 2,665,951 | 1/1954 | Bobst | 182/118 |
| 2,902,110 | 9/1959 | Eickholdt | 182/36 |
| 3,059,721 | 10/1962 | Straw | 182/38 |
| 3,340,960 | 9/1967 | Wilson | 182/117 |
| 3,391,757 | 7/1968 | Duke | 182/38 |
| 3,854,550 | 12/1974 | Shingler | 182/36 |

*Primary Examiner*—Reinaldo P. Machado
*Attorney, Agent, or Firm*—John F. McClellan, Sr.

[57] ABSTRACT

A track supported mobile ladder-scaffolding system with self-adjusting lateral supporting structure at the top for engaging a roof by means of a vehicle which engages track structure attachable to a roof by clamping: safety hook structure prevents support failure at the top at roof-engaging and ladder engaging points of the mobile portion of the system.

15 Claims, 3 Drawing Figures

MOBILE LADDER-SCAFFOLDING SYSTEM

This invention relates generally to ladder-type rolling-support scaffolding systems and specifically to an improved scaffolding system of the type which has rolling roof-engaging support.

In the prior art several disclosures in U.S. Patents relate to this type device:

- U.S. Pat. No. 1,692,664 to M. Kirsch, 11-20-28, discloses plural ladders cross-braced in-plane with a rung-supported platform between them and a pivotal (height compensating) hook to building structure;
- U.S. Pat. No. 2,043,312 to C. M. Warner, 6-9-36, discloses another form of rung-supported platform;
- U.S. Pat. No. 2,359,868 to H. Mick, 10-10-44, discloses a form of plural-ladder supported roof engaging staging structure;
- U.S. Pat. No. 2,663,484 to W. MacPherson, 12-22-53, discloses plural ladders supporting a building-attached platform with clamp attachment and adjustment;
- U.S. Pat. No. 2,665,951 to J. S. Bobst, 1-12-54, discloses among other things, plural ladders cross-braced in plane and supporting a platform;
- U.S. Pat. No. 2,902,110 to L. A. Eicholdt, 9-1-59, discloses a wheeled ladder structure with supporting rails;
- U.S. Pat. No. 3,340,960 to L. F. Wilson, 9-12-67, discloses a pair of in-plane ladders with a rung-attached platform between them, rollers and a track at the bottom for rolling support on the ground, rollers at the upper end for rolling support on a building, and in one embodiment, rollers on an extension for rolling support on a roof. The bottom rollers are captive inside the rail;
- U.S. Pat. No. 3,854,550 to Thomas M. Shingler, 12-17-34, discloses a platform movably supported for work on a building wall by plural ladders hung from trucks supported on rails on a roof.

However, it is believed that none of these disclosures alone or in combination provides the advantages of the present invention, particularly in the erection of prefabricated steel building wall sheeting, where working heights of forty feet or more may be encountered routinely. As result of the present invention this slowest and hardest aspect of the work can be done in a small fraction of the time usually required.

Objects of the invention, which have been proven in use are to provide a combinational system of the mobile scaffolding type which can be used on any ground contour, which can safely be shifted along the wall of a building with work platform structure fully loaded with workmen and tools, in which scaffold boards can be lifted easily to any desired height on the system, in which set-up and breakdown time required for the system is minimal and in any case faster than for conventional scaffolding and requires no crane, which needs to be set up only once for each wall and which bears no significant weight of the roof of the structure being sheathed and in no case will cause noticeable sag in such structure.

Other objects are to provide a system as described in which the major work-loads are carried to the ground through vertical ladder structure, the roof-loads being generally the same negligible amount regardless of whether the system is bear- a full complement of men and material and of whether standing or being moved; to provide such a system in which required attachment to the roof is at multiple locations and employs easily used, generally non-scarring materials and equipment of great simplicity and convenience and of self-evidencing security; and to provide such a system in which non-binding coaction of vertical and lateral subsystems preserves smooth movement of the overall system under adverse conditions as when uneven structural alignment in the work area is encountered, while automatically adjusting in infinitely small increments to any change in height of the roof relative to the ground support.

Further objects of the invention are to provide a system as described which affords extra safety for users through at least one back-up connection at each functioning point of securance, which safely maintains the same attitude relative to the roof-engaging portion regardless of differences in ground support; and which is quiet, steady and confidence-inspiring when moving as well as when stationary.

Still further objects are to provide a system as described which employs lightweight structure throughout, with a maximum of conventional parts for easy understanding and reliability, and which is easy to assemble, to disassemble and to transport.

In brief summary given as cursive description only and not as limitation the invention includes a ground engaging, vertical, mobile subsystem having anti-friction connection with a lateral, roof-engaging mobile subsystem.

The above and other objects and advantages of this invention will become more readily apparent on examination of the following description, including the drawings, in which:

FIG. 1 shows in an overview the system of this invention in embodiment 10 being used to apply sheathing S to a building wall B. For exposition the building is of a conventional prefabricated frame type with high-rib roofing joinings J.

THE VERTICAL STRUCTURE OF THE INVENTION

Figure 1:
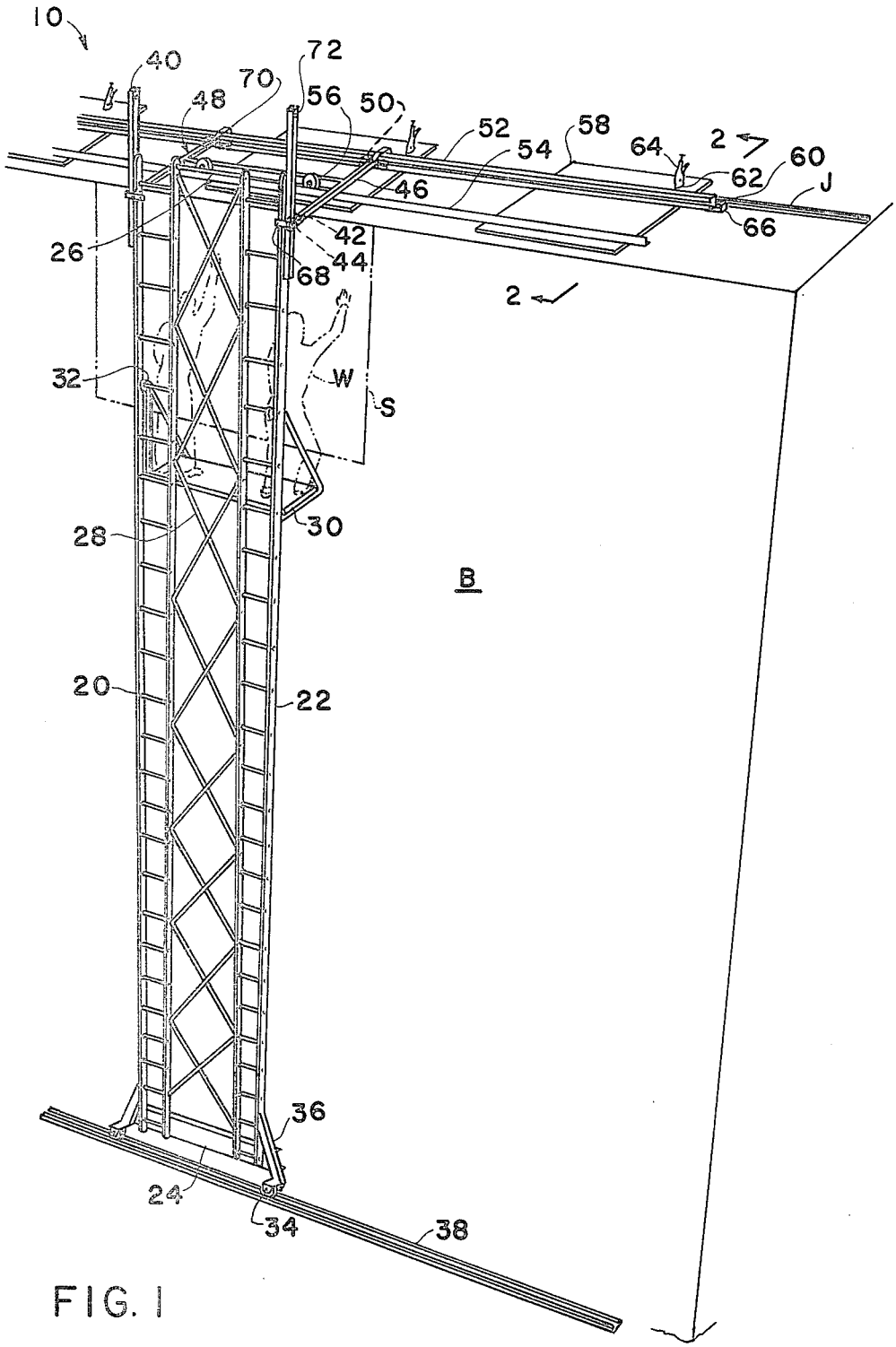
FIG. 1 is a perspective view of the invention in use.
Figure 2:
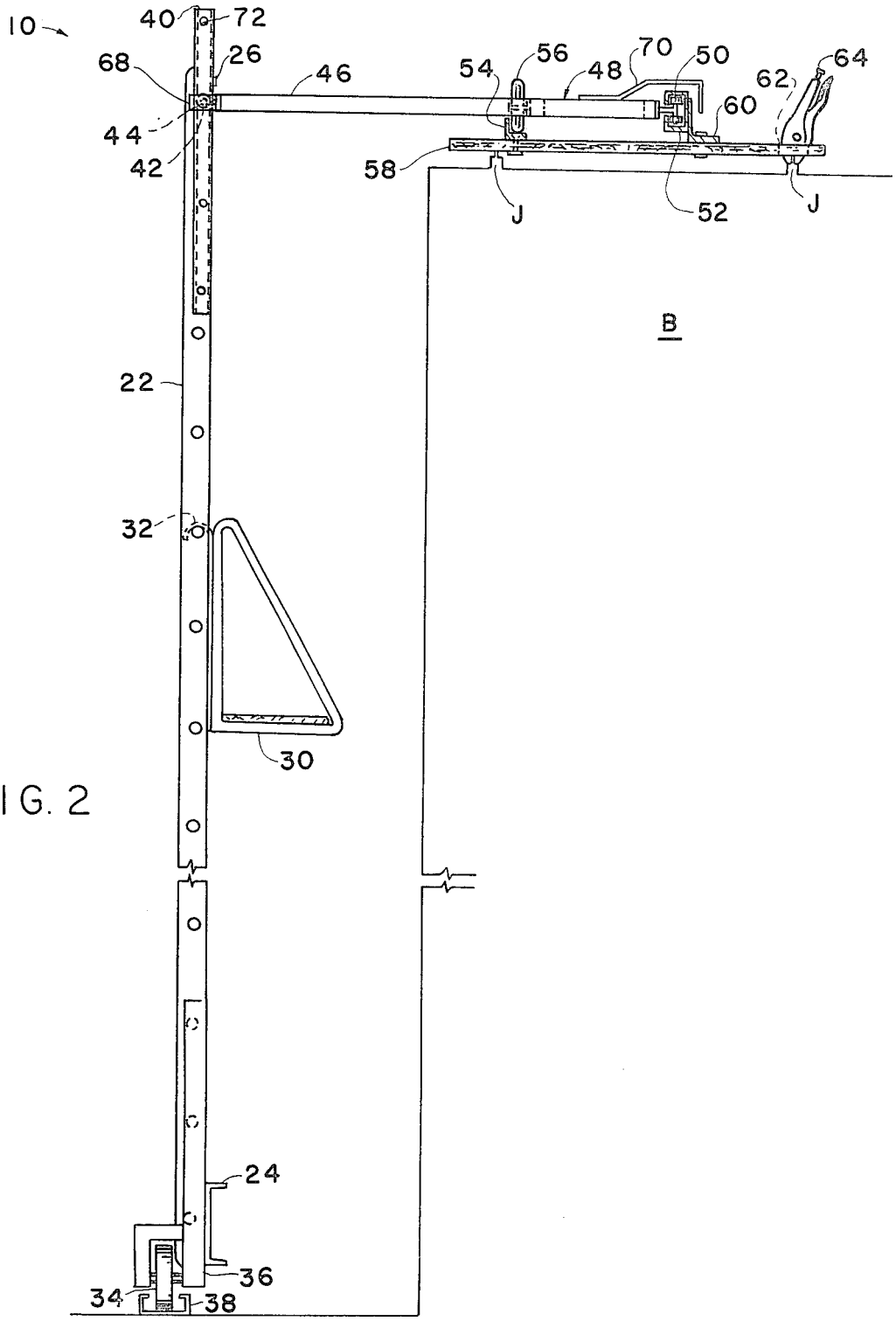
FIG. 2 is a diagrammatical detail adapted from 2—2, FIG. 1.
Figure 3:
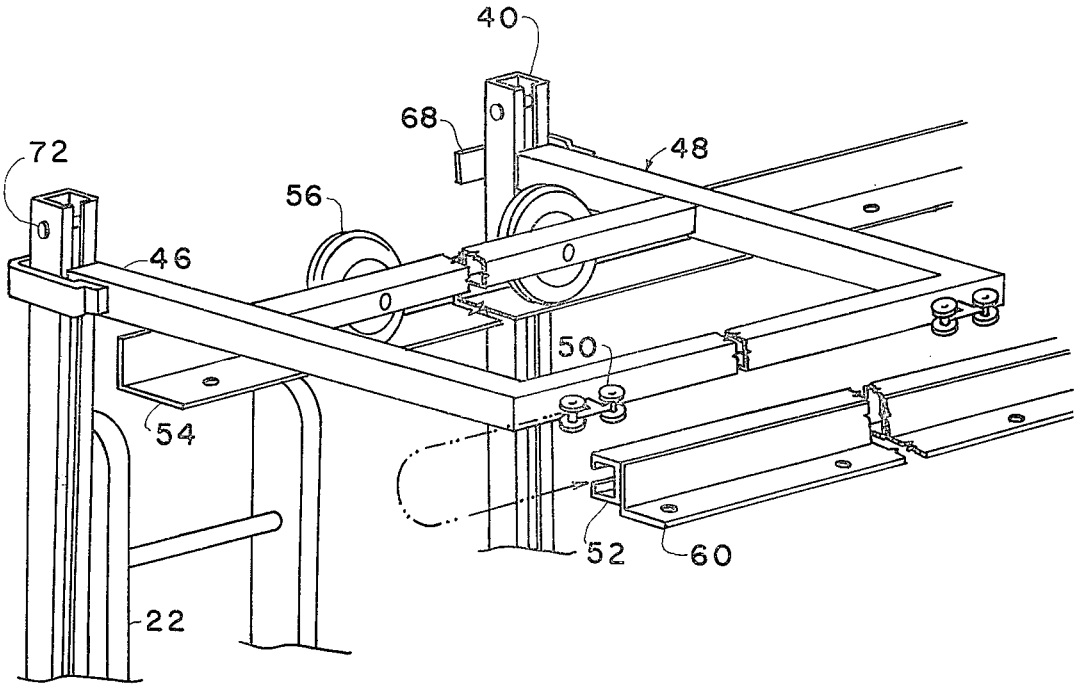
FIG. 3 is a perspective detail adapted from FIG. 2.

The vertical structure of the system includes at least two conventional ladders 20, 22, parallel-spaced in-plane as by a first transverse beam 24 bolted across the bottom, a second transverse beam 26 bolted across the top, and stabilized against oblique movement by diagonal structure, preferably several conventional scaffold cross bucks 28 similarly attached.

Workmen W stand on one or more working platforms 30 which span the ladders in horizontal direction, supported at any desired ladder-rung height by a rung-engaging hook 32 at each end of each platform. The ladders may be extension ladders inter-adjusted to project man-high above the roof of the building providing workman support for safety and convenience in stepping onto and off the roof.

Rolling support for movement of the system along the wall of a building being sheathed, constructed, painted or otherwise worked is provided by a respective steel wheel 34 at each end of the bottom beam.

The steel wheels journal in-plane with the ladders in respective brackets 36, somewhat wider apart than the ladder structure span, for additional stability, and run in a bottom track 38 which preferably is an "I" beam or squared, closed "C" section channel to contain the wheels as they roll along parallel to the building.

THE LATERAL STRUCTURE OF THE INVENTION

The form of movable securance to the building to hold the ladder structure vertical at all times comprises a significant contribution to the invention for the security, simplicity, self-adjustment, ease of assembly, economy, and protection of the building inherent in it.

In brief, it includes a rolling vehicle having first movable captive attachment to the roof through horizontal rails and second movable captive attachment to stabilize the vertical structure through vertical rails on the ladders.

In more detail, attachment of this lateral structure or roof-supported structure to the vertical structure is by means of a length of rectangular tubular longitudnially slotted or closed "C" section conveyor channel 40 bolted vertically along the upper end of the outboard leg of each ladder, with each channel longitudinal slot facing the building.

Running in captive engagement in each length of vertical conveyor channel is a roller 42 having an axle 44 journaled in a respective arm 46. The arms lead perpendicularly from the ladders onto the roof of the building where they form integral ends of a vehicle or sled 48 which has sides joining the arms, forming a rigid frame, rectangular in plan view.

The sled has at each rear corner or corner distant from the ladder a set or rollers 50 disposed within a length of conveyor channel 52 similar in section to that described above, but secured to the roof parallel with the building wall with the longitudinal slot facing toward the ladder structure, to function as a first longitudinal track for the sled. A second longitudinal track 54 for the sled paralleling the first track and lying between it and the ladder structure comprises in section an "L" shaped angle. A respective wheel 56 journaled in the rectangular frame near each forward corner of the sled rolls along this second track and in the manner of a fulcrum supports the weight of the sled, being substantially at the balance point of the sled.

At least one, and for jobs of any length several tie-plates 58 are spaced along the length of the conveyor channel and angle structures or first and second tracks and bolted to them, securing them to each other and to the roof. The channel preferably is secured to the tie plates through a length 60 of the same type angle as that of the second track.

The tie plates preferably are of sheets of exterior grade plywood so that they are non-splitting and durable but are easy to fashion and to handle and will not scar the roof structure when dragged over it or when in place.

Clamp structure, and preferably a particular type clamp structure, secures the tie plates to the roof so that the water tight integrity of the roof is not affected but with demonstrable safety and economy, as follows.

Each tie plate is adjusted by the bolting to the horizontal channel and angle so that it extends rearwardly of the horizontal channel a distance providing location for a hole 62 in it to pass a portion of a clamp 64 for clamped securance to a roof rib. This rearward extension keeps the tie plate attachment points clear of the vehicle for good access and in plain sight for inspection at any time.

Preferably the clamps are so-called wrench-pliers or "Vise-Grip" pliers with the hole in the tie plate passing the nose or jaw portion but too small to pass the larger section at the pivot of the pliers.

This structure provides a spring-tight "feel" assuring good gripping when the user clamps the tie plates and a vibration resistant securance, at very low cost and with the assurance of commercially proven parts, the proper operation of which is known to every skilled construction workman. Additionally, if a workman should neglect to clamp one of these devices onto a roof rib, a glance at the angular position of the device would reveal this.

Dimensions of the roof-supported structure of this system can vary to suit the job, the following having been found satisfactory for sheathing forty-foot high walls, the building having roof ribs which are 24 inches (60 cm) between centers and 2¾ inches (7 cm) high and ⅛ inch (0.3 cm) thick; conveyor channel 2 inches by 2 inches (5 cm by 5 cm) in section with 1/16 inch (0.15 cm) thick walls (this is "garage door size"); the sled tubing may be of similar dimensions; angle 1½ inch by 1½ inch (3.8×3.8 cm) legs with ⅛ inch (0.3 cm) thickness; plywood 31 inches by 31 inches by ¾ inch thick (79 by 79 by 1.9 cm) with hole 2½ inches (6.3 cm) in diameter, set back from the nearest edge to provide a 6 inch (15 cm) margin at the hole.

Any required length of the channel and angle system is provided by splicing lengths of first track may be staggered with respect to lengths of the angle supporting it, to maintain alignment better. An end-stop or bumper 66 is bolted to each end of either the first track or the second track or both to prevent sled over-run of the track.

Further safety features provided include a hook-shaped extension 68 on each arm which extends around the nearest ladder rail with a little clearance between, as a safety, a similar hook-shaped extension 70 on each arm which extends around to the rear of the first track with a little clearance between as a safety, and the upstanding leg of the angle of the second track also serves as a safety barrier to outward passage of the wheels. All these features comprise backups assuring no falling away of the ladder structure. A bolt 72 may be run through the top of either or both members 40 to assure retention of rollers 42 under all conditions.

It will be appreciated that when the ribs of the roof run perpendicular to the wall of the building, as when an end wall is being sheathed, the same clamping structure can be used, any necessary shift in tie plate location being made by easy relocation of bolt holes in the plywood ties. It will also be appreciated that more than one clamp per tie plate can be used, if desired. Further, when the rib roofing is of the type held down with exposed bolts, the bolts may be backed off and run through appropriate holes drilled in the plywood plates to clamp them without use of the vice grip pliers.

Assembly of the system from complete breakdown is extremely simple, even without an elevator or a winch. One or more workers climb by ladder onto the roof, hoist up and assemble and clamp the tie plates and first and second track structures, and install the sled on the tracks. Next the bottom track is installed and levelled by any conventional means, the ladders with vertical conveyor channel portions attached are leaned against the building and extended to the proper height, the bottom transverse beam and steel wheel assembly is attached, then the scaffold bucks and top transverse member are attached, the rollers on the arms of the sled are engaged with the vertical structure, the sled is then engaged with the lateral structure and the system is ready for use.

Although ordinary single ladders are shown it will be evident that ordinary extension ladders are equally usable in the invention, and further that the invention can be secured to roofs by conventional but less preferable means.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of mobile scaffolding including vertical structure with a plurality of ladders and means mounting the plurality of ladders movably as a unit on a bottom track for shifting location along the wall of a build-having roof structure, a work platform in said system having means for engaging rung structure of said ladders, and lateral means engaging the roof of the building to stabilize the vertical structure, the improvement comprising: at least one vertical track member on an upper portion of a said ladder, the lateral means including: horizontal track structure, means for fixing the horizontal track structure to a roof, a vehicle, first movable captive-engagement of the vehicle with the vertical track member, and second movable captive-engagement of the vehicle with a portion of the horizontal track structure.

2. In a system as recited in claim 1, said means for fixing comprising at least one tie plate, means for adjustably attaching the tie plate to the horizontal track structure, and means for clamping the tie plate to a roof.

3. In a system as recited in claim 2, the means for clamping including the tie plate having a hole therein, and the means for clamping including clamping means having a part thereof proportioned for reaching through said hole and securing to a roof.

4. In a system as recited in claim 3, the tie plate extending in a direction away from the vertical structure to a position beyond the horizontal track structure, and said hole located in said tie plate extension.

5. In a system as recited in claim 4, the clamping means being of the wrench-plier type, the part for reaching through the hole being the jaws thereof and the hole being too small to pass a portion of the wrench-plier type clamping means therethrough.

6. In a system as recited in claim 5, the tie plate being a plywood sheet.

7. In a system recited in claim 6, wherein the system includes a plurality of said tie plates and of respective said wrench-plier type clamping means therefor.

8. In a system as recited in claim 2, the horizontal track structure including a first track position comprising the portion having said second movable captive-engagement and a second track portion disposed between said first track portion and the vertical structure, wheel structure having rotatable attachment to the vehicle at a location supporting the vehicle on the second track structure.

9. In a system as recited in claim 8, said location being substantially such as to balance the weight of the vehicle thereat.

10. In a system as recited in claim 8, the first movable captive engagement including a respective said vertical track member at an outboard location on each of two said ladders each vertical track member being of tubular cross-sectional shape and having a longitudinal slot therealong, a respective arm extending from the vehicle toward the longitudinal slot and having a portion extending through the slot with roller means thereon engaging the respective vertical track member.

11. In a system as recited in claim 10, the second movable captive engagement including the first track portion having a tubular cross section and a longitudinal opening therealong, each said respective arm having a portion extending through the opening with roller means thereon engaging the first track portion.

12. In a system as recited in claim 11, each said arm having a hook thereon extending around a portion of a respective vertical track member.

13. In a system as recited in claim 12, said vehicle having a hook-shaped member thereon extending around a portion of the horizontal track structure.

14. In a system as recited in claim 11, a longitudinal angle supporting the first track portion to said at least one tie plate.

15. In a system as recited in claim 14, an end-stop on the horizontal track structure for preventing overrunning of said vehicle.

* * * * *